US007537509B2

(12) United States Patent
Payne et al.

(10) Patent No.: US 7,537,509 B2
(45) Date of Patent: May 26, 2009

(54) TOY TRACK DEVICES

(75) Inventors: Julian Payne, Los Angeles, CA (US); Felix Holst, Venice, CA (US); Matt Agostina, Hermosa Beach, CA (US)

(73) Assignee: Mattel, Inc., El Segundo, CA (US)

( * ) Notice: Subject to any disclaimer, the term of this patent is extended or adjusted under 35 U.S.C. 154(b) by 0 days.

(21) Appl. No.: 11/811,681

(22) Filed: Jun. 11, 2007
(Under 37 CFR 1.47)

(65) Prior Publication Data

US 2008/0113585 A1 May 15, 2008

Related U.S. Application Data

(60) Provisional application No. 60/812,151, filed on Jun. 9, 2006.

(51) Int. Cl.
*A63H 18/00* (2006.01)
*A63H 29/00* (2006.01)

(52) U.S. Cl. ..... 446/444; 446/429; 446/431

(58) Field of Classification Search ..... 446/444, 446/429, 431; 273/118, 119
See application file for complete search history.

(56) References Cited

U.S. PATENT DOCUMENTS

| | | | | |
|---|---|---|---|---|
| 738,586 | A | 9/1903 | WIlson | |
| 740,765 | A | 10/1903 | Koster | |
| 749,607 | A | 1/1904 | Dutrieu | |
| 1,431,398 | A | 10/1922 | Hetzner | |
| 1,493,649 | A | 5/1924 | Schulz | |
| 1,523,244 | A | 1/1925 | Bain | |
| 1,603,180 | A | 10/1926 | Zabel | |
| 1,662,162 | A | 3/1928 | Nestor | |
| 1,715,891 | A | 6/1929 | Beck | |
| 1,914,116 | A | 6/1933 | Ford | |
| 1,965,676 | A | 7/1934 | Stock | |
| 2,101,354 | A * | 12/1937 | Williams | 273/118 A |
| 2,168,010 | A | 8/1939 | Verplanck | |
| 2,171,634 | A | 9/1939 | Rexford et al. | |
| 2,198,306 | A | 4/1940 | Fisher | |
| 2,211,220 | A | 8/1940 | Verplanck | |

(Continued)

FOREIGN PATENT DOCUMENTS

| | | |
|---|---|---|
| DE | 3106081 | 8/1982 |

OTHER PUBLICATIONS

International Search Report, Aug. 25, 2008, 2 pages, U.S. Patent and Trademark Office.
Written Opinion, Aug. 25, 2008, 5 pages, U.S. Patent and Trademark Office.

*Primary Examiner*—Gene Kim
*Assistant Examiner*—Michael D Dennis
(74) *Attorney, Agent, or Firm*—Kolisch Hartwell, P.C.

(57) ABSTRACT

A toy track device is disclosed. In some embodiments, the toy track device may include a door configured to move between a closed position in which first, second, and third track portions form a continuous track, and an open position in which the door forms an opening in the third track portion through which the at least one moveable object can pass; and an actuator mechanism including an actuator configured to move between an extended and a retracted position, the actuator contacting a moveable object when the moveable object is supported on the door and the actuator is moved from the retracted position toward the extended position, wherein the door is configured to move from a closed position to an open position when the moveable object is supported on the door and the actuator presses against the moveable object while the actuator is moving toward the extended position.

18 Claims, 7 Drawing Sheets

U.S. PATENT DOCUMENTS 2,214,310 A 9/1940 Schreffler
2,239,395 A 4/1941 Mallory
2,401,468 A 6/1946 Duffy
2,616,630 A 11/1952 Michele
2,618,437 A 11/1952 Matthaeis, Jr.
2,726,869 A 12/1955 Schulte
2,815,872 A 12/1957 Graham
2,853,301 A 9/1958 Glass
2,998,196 A 8/1961 Eenigenburg, Jr.
3,074,200 A 1/1963 Ziegenfuss
D197,616 S 3/1964 Dunbar
3,126,670 A 3/1964 Smith
3,204,574 A 9/1965 Frisbie et al.
3,209,491 A 10/1965 Roeper
D204,468 S 4/1966 Smedley et al.
3,289,830 A 12/1966 Foote
3,299,565 A 1/1967 Yarashes
3,315,632 A 4/1967 Hyden
3,376,844 A 4/1968 Wood
3,502,332 A 3/1970 Wolf
3,542,366 A 11/1970 Schocker
3,589,063 A 6/1971 Genin
3,618,947 A 11/1971 Cooper et al.
3,621,602 A 11/1971 Barcus et al.
3,648,454 A 3/1972 Morrison
3,658,333 A 4/1972 Carcel
3,665,636 A 5/1972 Benson et al.
3,674,269 A 7/1972 Cooper et al.
3,690,393 A 9/1972 Guy
3,712,615 A 1/1973 Staats et al.
3,735,923 A 5/1973 Brigham et al.
3,777,394 A 12/1973 Staats et al.
3,797,164 A 3/1974 Glass et al.
3,827,693 A 8/1974 Barlow et al.
D233,620 S 11/1974 Seki
3,858,875 A 1/1975 Nemeth et al.
3,860,237 A 1/1975 Cooper et al.
3,939,979 A 2/1976 Neumayer
3,970,309 A 7/1976 Sato
4,068,402 A 1/1978 Tanaka
4,077,628 A 3/1978 Hebert
4,087,935 A 5/1978 Edmisson et al.
4,094,089 A 6/1978 Sano
4,108,437 A 8/1978 DeAnda et al.
4,146,991 A 4/1979 Sano
4,185,409 A 1/1980 Cheng
4,202,464 A 5/1980 Mohs et al.
4,221,076 A 9/1980 Ozawa
4,254,576 A 3/1981 Matsumoto et al.
4,349,983 A 9/1982 Kilroy et al.
4,355,807 A 10/1982 Prehodka
4,423,871 A 1/1984 Mucaro
4,468,031 A 8/1984 Barlow et al.
4,475,881 A 10/1984 Borst et al.
4,493,265 A 1/1985 Miura
4,496,100 A 1/1985 Schwager et al.
4,513,966 A 4/1985 Mucaro et al.
4,513,967 A 4/1985 Halford et al.
4,519,789 A 5/1985 Halford et al.
4,536,168 A 8/1985 Stephens
4,558,867 A 12/1985 Hippely
4,564,197 A 1/1986 Lambert et al.
RE32,106 E 4/1986 Lemelson
4,605,229 A 8/1986 McKay
4,606,545 A * 8/1986 Ritchie ..... 273/121 A
4,661,080 A 4/1987 Goldstein et al.
4,697,812 A 10/1987 Rudell et al.
4,715,602 A 12/1987 May et al.
4,715,843 A 12/1987 Ostendorff et al.
4,767,053 A 8/1988 Cook et al.
4,872,680 A 10/1989 Dennis
4,905,828 A 3/1990 Dods
4,925,188 A 5/1990 McKay et al.
4,937,207 A 6/1990 Simmell et al.
4,979,926 A 12/1990 Bisceglia
5,038,685 A 8/1991 Yoneda et al.
5,052,972 A 10/1991 Suimon et al.
5,174,569 A 12/1992 Ngai
5,234,216 A 8/1993 Ostendorff
5,237,763 A 8/1993 Ochoa
5,254,030 A 10/1993 Ostendorff et al.
D344,104 S 2/1994 Yen
5,370,223 A 12/1994 Leicht, Jr.
5,440,996 A 8/1995 Cottino
5,452,893 A 9/1995 Faulk et al.
5,542,668 A 8/1996 Casale et al.
5,586,923 A 12/1996 Hippely et al.
5,601,490 A 2/1997 Nakagawa et al.
5,611,432 A 3/1997 Dods
5,651,736 A 7/1997 Myers
5,676,586 A 10/1997 James
5,678,489 A 10/1997 Wang
5,741,010 A * 4/1998 Weyna ..... 273/119 A
5,758,777 A 6/1998 Dods
5,767,655 A 6/1998 Ostendorff et al.
5,813,351 A 9/1998 Chen
5,865,661 A 2/1999 Cyrus et al.
5,890,945 A 4/1999 Asami et al.
5,899,789 A 5/1999 Rehkemper et al.
6,000,992 A 12/1999 Lambert
6,074,269 A 6/2000 Rothbarth et al.
6,109,186 A 8/2000 Smith et al.
6,132,287 A 10/2000 Kuralt et al.
6,152,298 A 11/2000 Dods
6,176,760 B1 1/2001 Ngai
6,193,581 B1 2/2001 Wiggs et al.
6,216,600 B1 4/2001 Verret
6,241,573 B1 6/2001 Ostendorff et al.
6,358,112 B1 3/2002 Lambert et al.
6,435,929 B1 8/2002 Halford
6,439,955 B1 8/2002 Feketo
6,478,654 B1 11/2002 Rehkemper et al.
6,508,179 B2 1/2003 Annis et al.
6,517,007 B2 2/2003 Kong
6,572,434 B2 6/2003 Man
6,601,774 B1 8/2003 Kasimoff
6,647,893 B1 11/2003 Fugitt et al.
6,676,480 B2 1/2004 Sheltman
6,692,329 B2 2/2004 Peters
6,695,668 B2 2/2004 Donahue et al.
6,733,361 B1 5/2004 Rudell
6,736,330 B2 5/2004 Kanda
6,783,417 B2 8/2004 Morrissy et al.
6,783,419 B1 8/2004 Paukert et al.
6,830,498 B2 12/2004 Elling
6,883,720 B2 4/2005 D'Angelo, Jr. et al.
6,908,396 B1 6/2005 Billig
6,913,508 B2 7/2005 Hornsby et al.
6,935,574 B2 8/2005 Cheng
6,951,307 B2 10/2005 Lin
6,951,497 B1 10/2005 Ngan
6,951,498 B2 10/2005 Rudell
7,025,656 B2 4/2006 Bailey
7,025,677 B2 4/2006 Kawase
2002/0195502 A1 12/2002 Delage
2003/0224697 A1 12/2003 Sheltman et al.
2004/0238655 A1 12/2004 Monk
2005/0191940 A1 9/2005 Sheltman et al.

* cited by examiner

TOY TRACK DEVICES

CROSS-REFERENCE TO RELATED APPLICATIONS

This application claims priority under 35 U.S.C. § 119(e) to U.S. Provisional Patent Application No. 60/812,151 entitled "Interactive Toy Vehicle Playset," filed Jun. 9, 2006. The complete disclosure of the above application is herein incorporated by reference for all purposes.

BACKGROUND OF THE DISCLOSURE

The present disclosure is directed to toy track devices for at least one moveable object, including toy track devices that may be used with one or more toy playsets.

Examples of toy playsets, including toy playsets with track assemblies, are found in U.S. Pat. Nos. 740,765; 749,607; 1,431,398; 1,523,244; 1,603,180; 1,715,891; 1,965,676; 2,239,395; 2,815,872; 3,126,670; 3,204,574; 3,209,491; 3,299,565; 3,665,636; 3,690,393; 3,797,164; 3,858,875; 4,068,402; 4,087,935; 4,094,089; 4,185,409; 4,221,076; 4,254,576; 4,355,807; 4,423,871; 4,468,031; 4,493,265; 4,496,100; 4,513,967; 4,519,789; 4,536,168; 4,661,080; 4,697,812; 4,715,843; 4,767,053; 4,979,926; 5,038,685; 5,052,972; 5,174,569; 5,452,893; 5,601,490; 5,678,489; 5,865,661; 5,890,945; 6,074,269; 6,132,287; 6,176,760; 6,193,581; 6,216,600; 6,241,573; 6,358,112; 6,435,929; 6,439,955; 6,478,654; 6,508,179; 6,517,007; 6,572,434; 6,676,480; 6,692,329; 6,695,668; 6,733,361; 6,736,330; 6,783,417; 6,830,498; 6,883,720; 6,908,396; 6,913,508; 6,935,574; 6,951,307; 6,951,498; 7,025,656; and RE 32,106, and U.S. Patent Application Publication No. 2003/0224697. The complete disclosures of the above patents and patent application are herein incorporated by reference for all purposes.

SUMMARY OF THE DISCLOSURE

Some embodiments provide a toy track device for at least one moveable object. In some embodiments, the toy track device may include first and second track portions; a third track portion disposed between the first and second track portions, the third track portion including a door configured to move between a closed position in which the first, second, and third track portions form a continuous track, and an open position in which the door is spaced away from the first and second track portions forming an opening in the third track portion through which the at least one moveable object can pass; and an actuator mechanism including an actuator configured to move between an extended position in which the actuator is adjacent to the door, and a retracted position in which the actuator is spaced away from the door, the actuator contacting the at least one moveable object when the at least one moveable object is supported on the door and the actuator is moved from the retracted position toward the extended position, wherein the door is configured to move from the closed position to the open position when at least one moveable object is supported on the door and the actuator presses against the at least one moveable object while the actuator is moving from the retracted position toward the extended position.

In some embodiments, the toy track device may include first and second track portions; a third track portion disposed between the first and second track portions, the third track portion including a door configured to move between a closed position in which the first, second, and third track portions form a continuous track, and an open position in which the door is spaced away from the first and second track portions forming an opening in the third track portion through which the at least one toy vehicle can pass; an actuator mechanism including an actuator configured to move between an extended position in which the actuator is adjacent to the door, and a retracted position spaced away from the door, the actuator contacting the at least one toy vehicle when the at least one toy vehicle is supported on the door and the actuator is moved from the retracted position toward the extended position, wherein the door is configured to move from the closed position to the open position when at least one toy vehicle is supported on the door and the actuator presses against the at least one toy vehicle while the actuator is moving toward the extended position; and an indexing mechanism configured to move the actuator between the extended and retracted positions.

Some embodiments provide a toy track device. In some embodiments, the toy track device may include a track having an opening through which an object can pass; a door mounted relative to the track and configured to move between a closed position in which the door closes the opening, and an open position in which the door is spaced from the opening; a bias mechanism configured to urge the door toward the closed position; and an actuator mechanism including an actuator configured to move between a retracted position in which the actuator is spaced from the door, and an extended position in which the actuator is adjacent to the door, the actuator mechanism being operable to move the door from the closed position toward the open position by moving the actuator element from the retracted position toward the extended position.

DETAILED DESCRIPTION OF THE DISCLOSURE

FIGS. 1-6 show an example of a toy track device 20 for at least one moveable object 22. The moveable object may include any suitable structure configured to move on and/or be supported by one or more portions of the toy track device.

Figure 5:
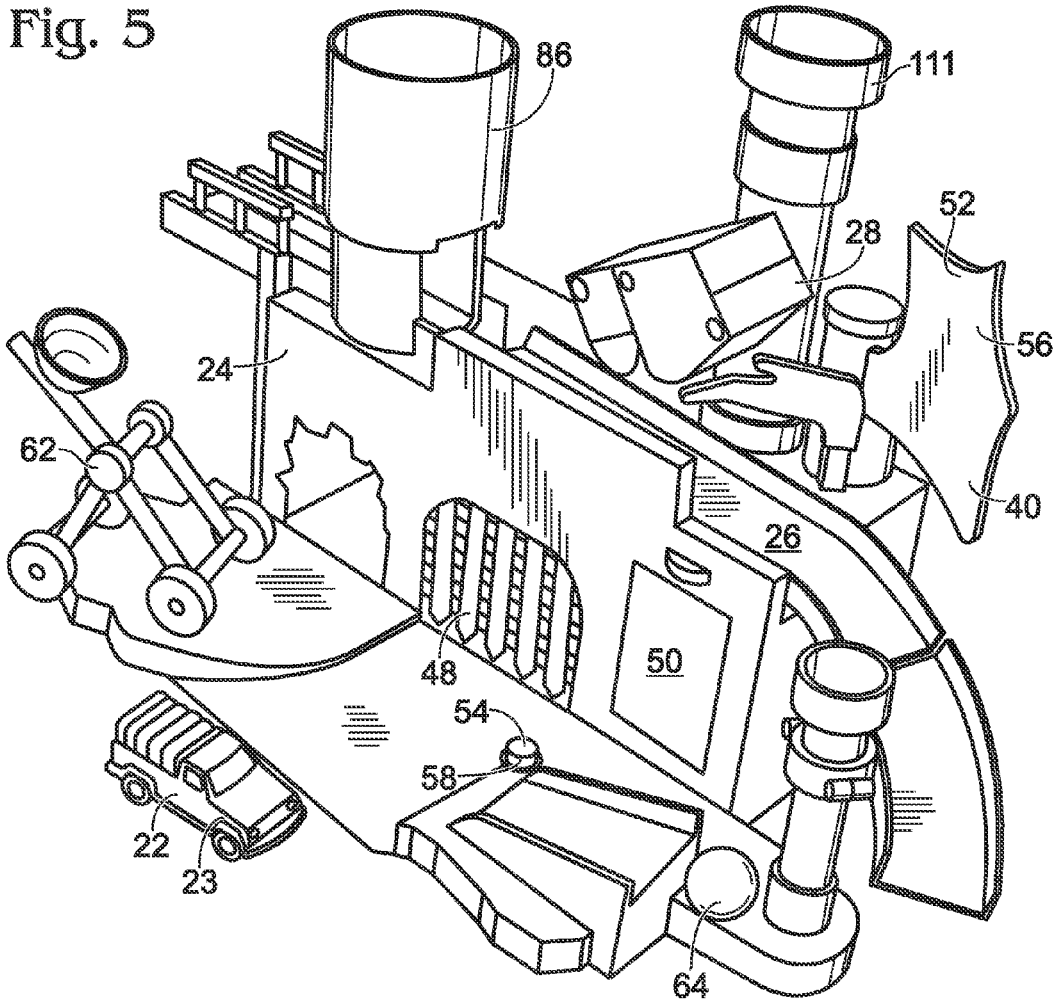
FIG. 5 is an isometric view of the toy track device of FIG. 1 with some portions of the toy track device removed to show a first trigger for a first holding door.
Figure 6:
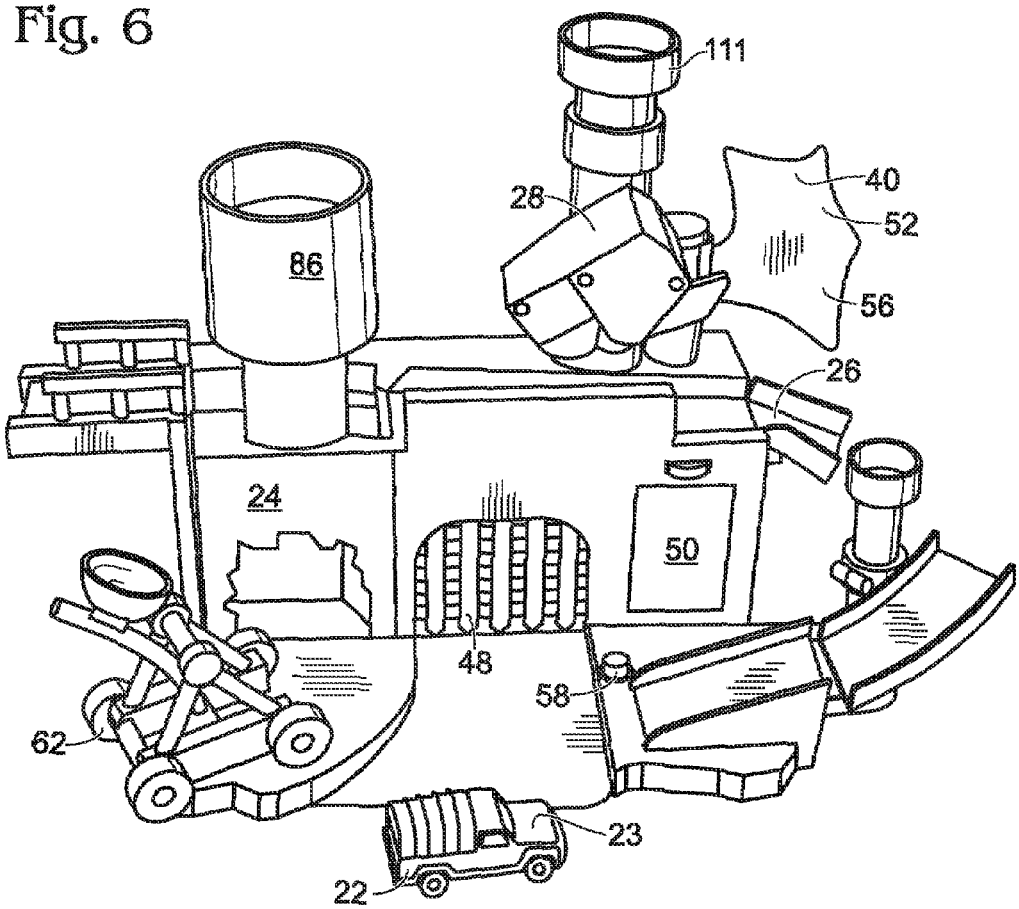
FIG. 6 is a front view of the toy track device of FIG. 1 with some portions of the toy track device removed to show a first trigger for a first holding door.
Figure 8:
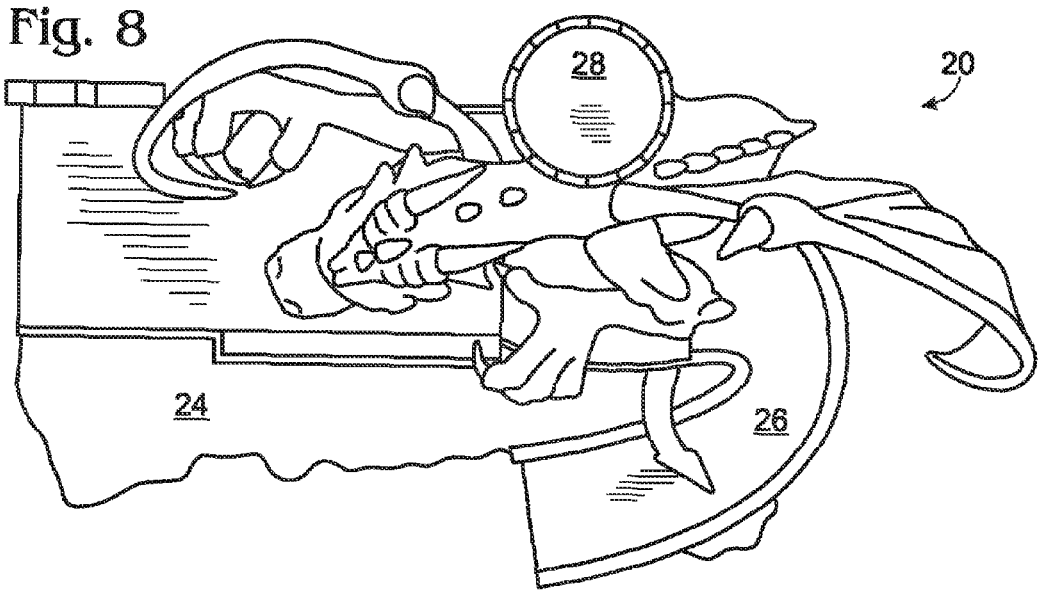
FIG. 8 is a top view of the toy track device of FIG. 7 shown without a lifting mechanism.
Figure 7:
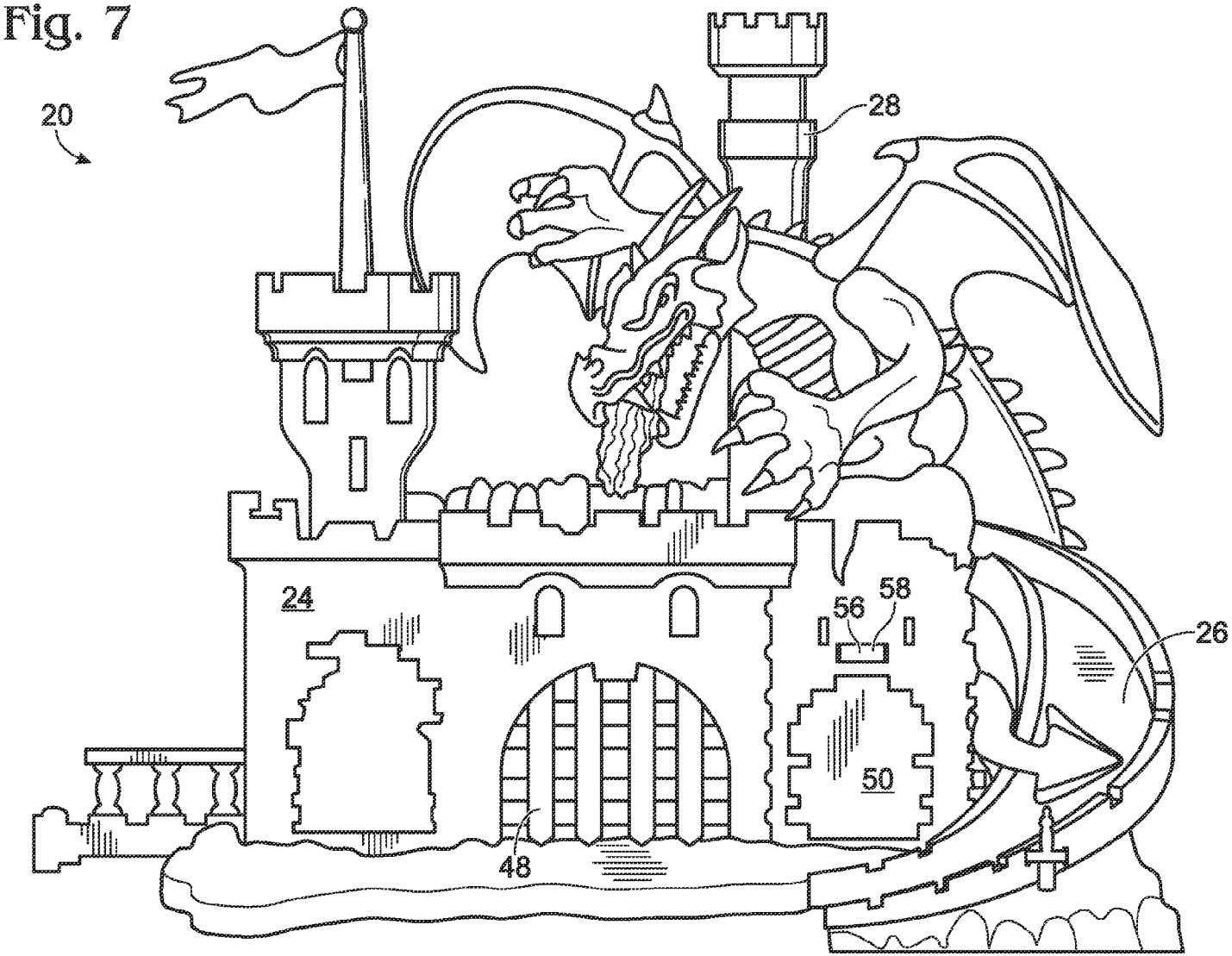
FIG. 7 is front view of another example of a toy track device.
Figure 9:
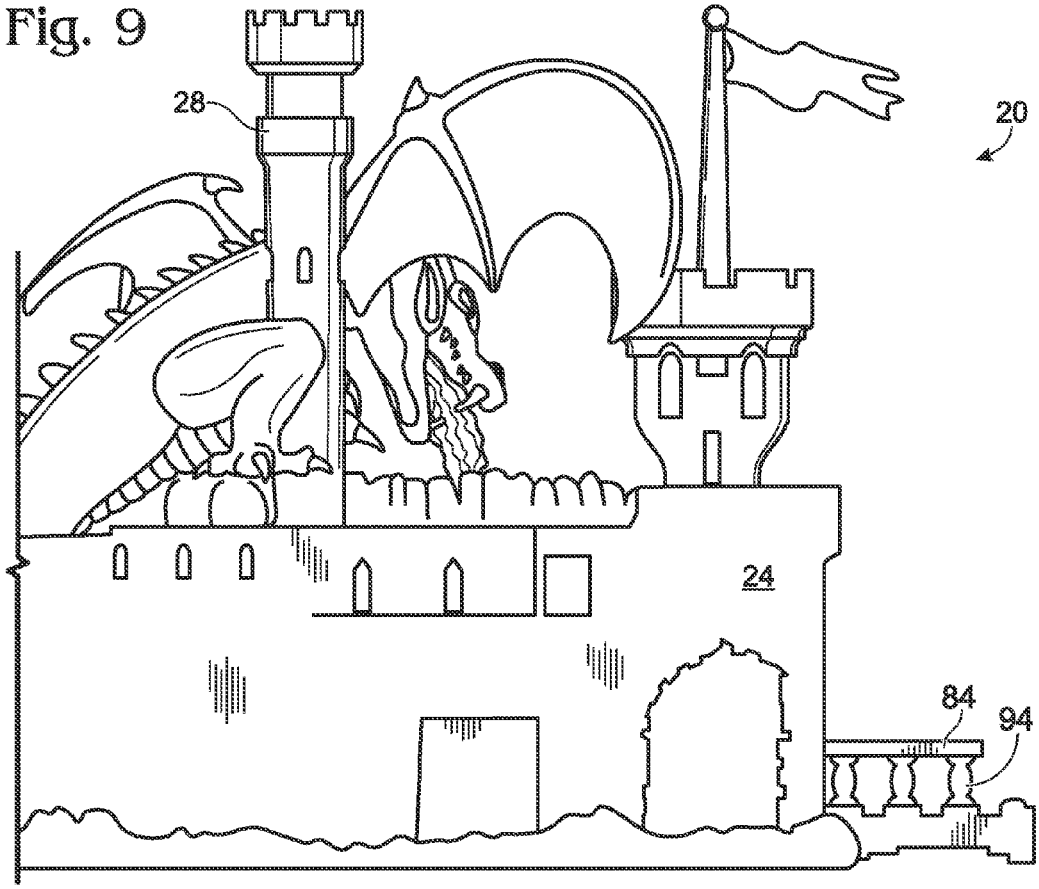
FIG. 9 is a partial rear view of the toy track device of FIG. 7.
Figure 10:
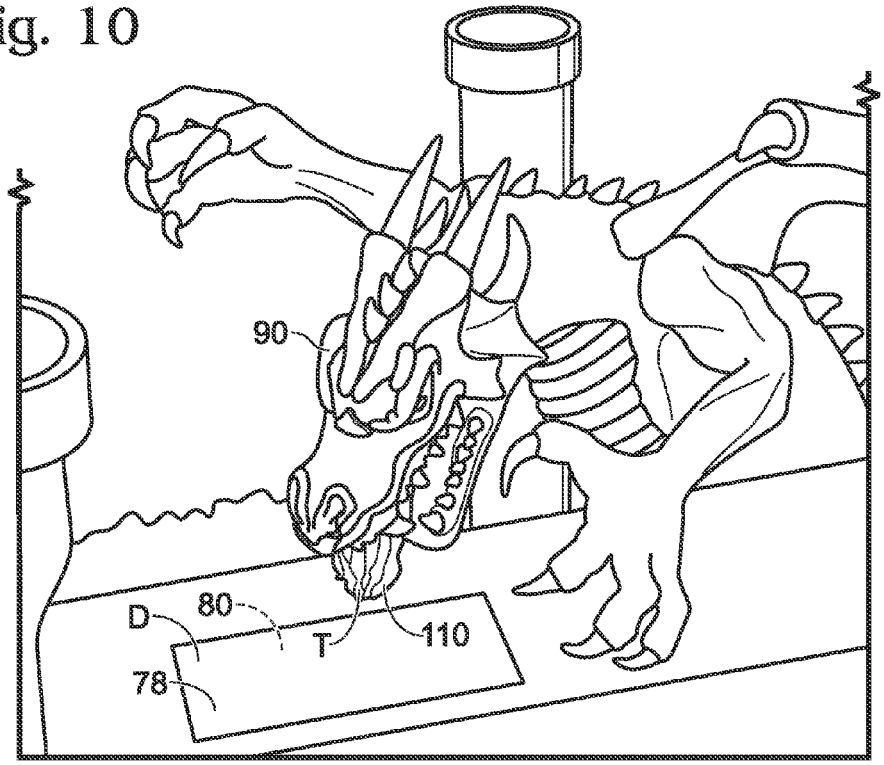
FIG. 10 is a partial isometric view of the toy track device of FIG. 7 shown with an actuator in an unactuated position.
Figure 11:
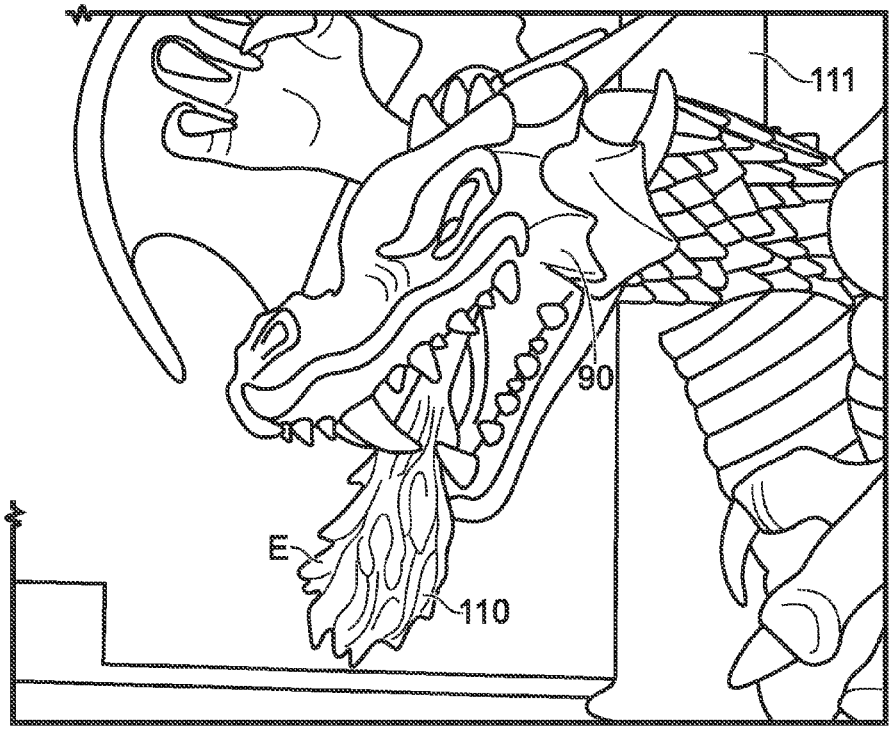
FIG. 11 is a partial isometric view of the toy track device of FIG. 7 shown with an actuator in an actuated position.

For example, the moveable object may include at least one toy vehicle 23, as shown in FIGS. 5-6.

The toy vehicle may be self-propelled and/or may need one or more external forces, such as forces from a person, gravity, a lift mechanism, and/or a launch mechanism, to move the toy vehicle. Toy vehicle 23 may have four wheels and include a body and/or frame that resembles a pick-up truck. Although toy vehicle 23 is shown with a particular structure and aesthetic features are shown, the toy vehicle may include any suitable structure and/or may have any suitable aesthetic features. For example, the toy vehicle may have any suitable number of wheels, such as three wheels, two wheels, or one wheel.

Additionally, or alternatively, the toy vehicle may have a body and/or frame with aesthetic features that resemble a sport-utility vehicle, a race vehicle, a luxury vehicle, a motorcycle, an all-terrain vehicle, a cycle with one or more wheels (such as a unicycle, bicycle, or tricycle), etc. Alternatively, or additionally, moveable object 22 may include other type(s) of objects. For example, the moveable object may include one or more balls (such as marbles) and/or one or more mobile toy figures (such as toy figures with wheels or toy figures on skateboards, rollerblades, or roller-skates).

The toy track device may include a base 24, a track assembly 26, and a regulating assembly 28. The base may include any suitable structure configured to at least partially support one or more components of the track assembly, the launch assembly, and/or the regulating assembly. Additionally, or alternatively, base 24 may include any suitable structure configured to store and/or receive moveable object 22 and/or other object(s).

For example, base 24 may include a lower level portion 32, an upper level portion 34, one or more holding areas 36, one or more holding doors 38, and one or more access mechanisms 40. The holding areas may include any suitable structure configured to receive and/or store moveable object 22 and/or other objects. Holding areas 36 may be positioned in any suitable portion(s) of the base. For example, one or more of the holding areas may be positioned below one or more portions of the track assembly, such as to receive moveable object 22 when the at least one movable object passes through an opening of the track assembly. In some embodiments, holding areas 36 may include a first holding area 42 and a second holding area 44.

The first holding area may be configured to receive and/or store moveable object 22 at lower level portion 32, such as moveable object 22 that is diverted from track assembly 26 or that passes through an opening of the track assembly. Second holding area 44 may be configured to receive and/or store one or more objects 46, such as one or more toy treasures, at lower level portion 32. In some embodiments, the object(s) may be sized to be carried by moveable object 22.

Figure 1:
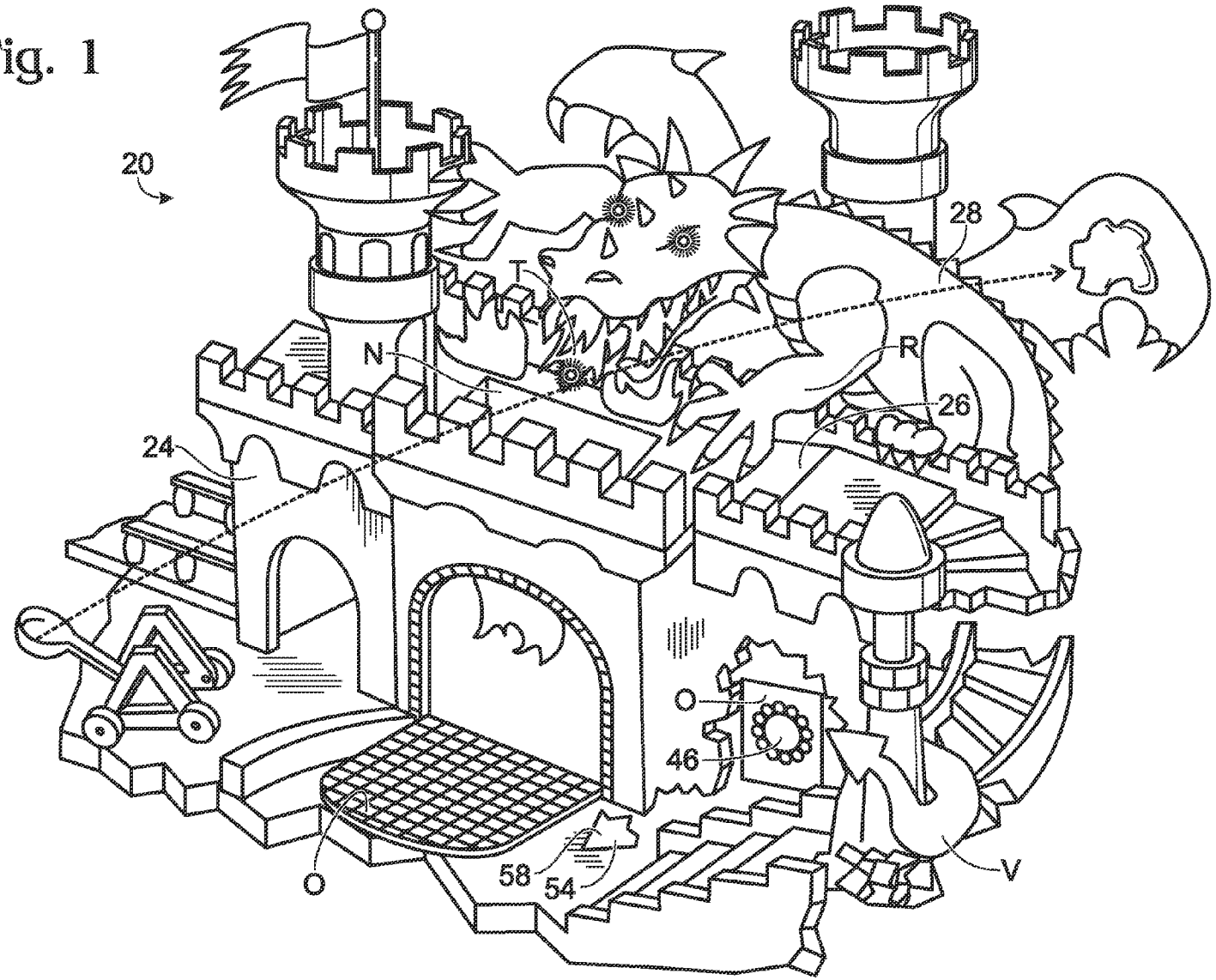
FIG. 1 is an isometric view of an example of a toy track device.
Figure 2:
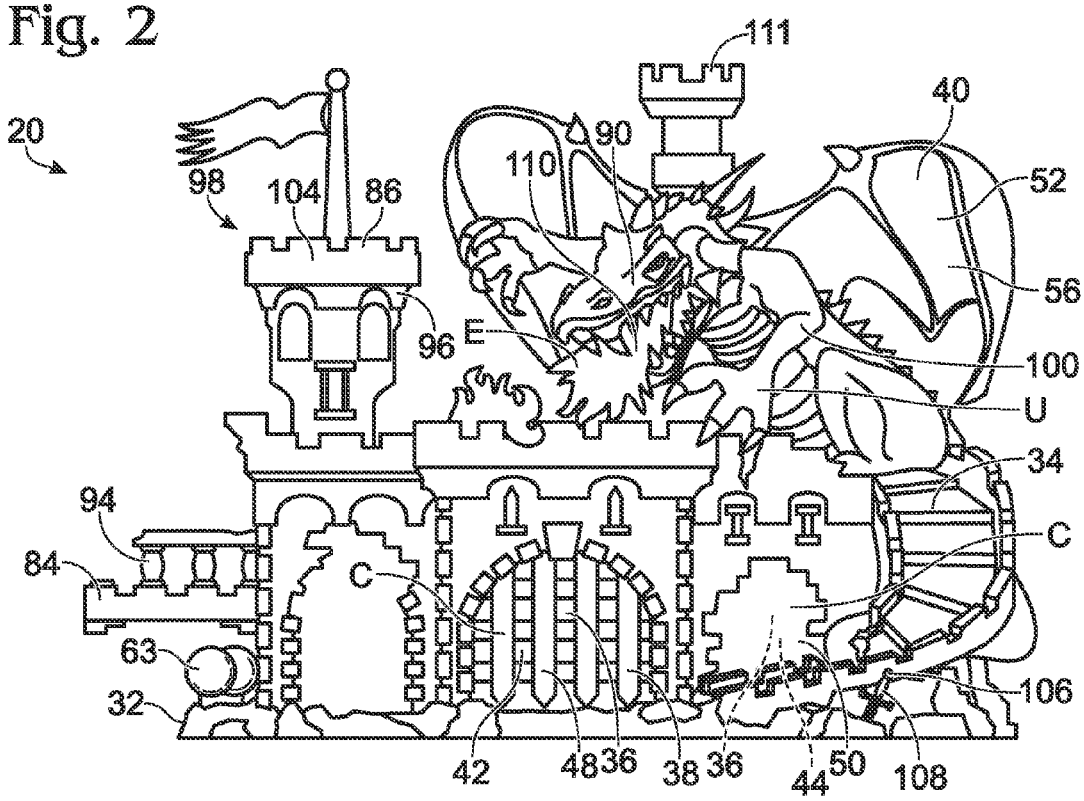
FIG. 2 is a front view of the toy track device of FIG. 1.
Figure 3:
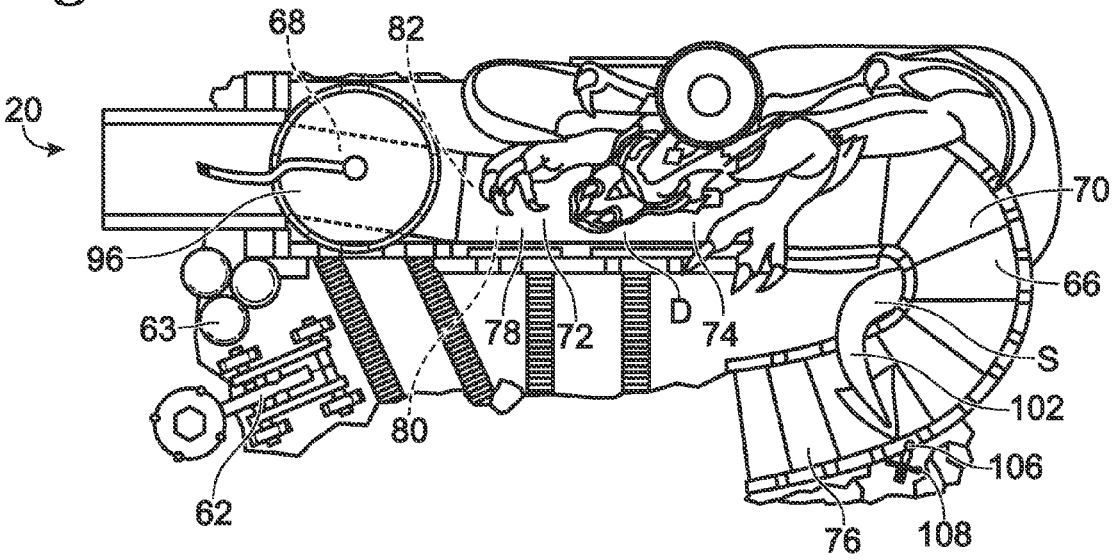
FIG. 3 is a top view of the toy track device of FIG. 1.

Holding doors 38 may control access to the holding areas. For example, the holding doors may be configured to move between a closed position C, shown in FIG. 2, in which removal of moveable object 22 and/or other object(s) from the holding areas is prevented, and an open position O, shown in FIG. 1, in which removal of moveable object 22 and/or other object(s) from the holding area is allowed. The holding doors may be positioned in any suitable portion(s) of the base. For example, holding doors 38 may include a first holding door 48 and a second holding door 50, as shown in FIGS. 1-3. The first and second holding doors may be movably connected to any suitable portion(s) of the base. For example, first holding door 48 may be pivotally connected to lower level portion 32, while second holding door 50 may be rotatably connected to lower level portion 32.

Although two holding areas 36 and two holding doors 38 are shown, base 24 may include any suitable number of holding areas and/or holding doors. Additionally, although holding areas 36 and holding doors 38 are shown to be positioned in lower level portion 32, the holding areas and/or holding doors may alternatively, or additionally, be positioned in upper level portion 34. Moreover, although first holding door 48 is shown to be pivotally connected to lower level portion 32 and second holding door 50 is shown to be rotatably connected to the lower level portion, the holding doors may be movably connected to the base in any suitable way(s). Furthermore, although holding areas 36 are shown to be sized to contain a single moveable object 22 or a single object 46, one or more of the holding areas may be sized to contain any suitable number of moveable objects 22 and/or objects 46.

Access mechanisms 40 may include any suitable structure configured to move one or more of holding doors 38 between the open and closed positions, such as from the closed position to the open position. For example, access mechanisms 40 may include a first access mechanism 52 and a second access mechanism 54. The first access mechanism may include a first trigger 56 (as shown in FIGS. 5-6), such as a lever, that may be triggered to move first holding door 48 from the closed position to the open position. Second access mechanism 54 may include a second trigger 58, such as a button or a turn knob, that may be triggered to move second holding door 50 from the closed position to the open position. In some embodiments, the second trigger may be accessible to a user only after the first trigger has been triggered and/or holding door 48 has moved from the closed position to the open position. Although first trigger 56 is shown to include a lever and second trigger 58 is shown to include a button, the first and second triggers may alternatively, or additionally, include any suitable structure to allow a user to selectively move one or more of the holding doors between the open and closed positions, such as one or more cables, cords, knobs, etc.

In some embodiments, the access mechanisms may include one or more bias elements (not shown) configured to urge one or more of the holding doors in the open and/or closed positions. The bias elements may include any suitable structure, including coil spring(s), leaf spring(s), musical wire(s), etc. In some embodiments, access mechanism 40 may include a launch mechanism 62 having a launch trigger 63, and one or more launch members 64.

The launch mechanism may include any suitable structure configured to propel the launch member(s) toward the first and/or second triggers. For example, launch mechanism 62 may include a toy catapult, while launch members 64 may include toy rocks. The launch mechanism may propel the launch members by activating the launch trigger. One or more of the access mechanisms may be configured to move the holding door(s) between the closed position and the open position, such as from the closed position to the open position, responsive to the launch member contacting the associated trigger(s). For example, first trigger 56 may be contacted by launch member 64 to move the first holding door from the closed position to the open position.

Although launch mechanism 62 is shown to include a toy catapult, the launch mechanism may include any suitable structure configured to launch one or more launch members 64 toward one or more of the triggers. Additionally, although base 24 is shown to include holding areas 36, holding doors 38, and access mechanisms 40, the base may alternatively, or additionally, include any suitable structure configured to at least partially support one or more components of the track assembly and/or the regulating assembly and/or store and/or receive moveable object 22 and/or other object(s).

Track assembly 26 may include any suitable structure configured to support movable object 22. For example, track assembly 26 may include a track 66. Track 66 may be any suitable size(s) and/or shape(s). For example, track 66 may be at least substantially "J" shaped with a first portion supported on upper level portion 34 and a second portion supported on lower level portion 32 of base 24. Although track 66 is shown to be "J" shaped, the track may alternatively, or additionally, be any suitable shape(s). For example, track 66 may be circular or oblong shaped. Additionally, although track 66 is shown to be supported on the upper and lower level portions of the base, the track may be supported on only the upper level portion or only the lower level portion. In some embodiments, at least part of the track may be incorporated with the base.

Track 66 may include a first track portion 68, a second track portion 70, and a third track portion 72 disposed between the first and second track portions. First track portion 68 may be movably connected to upper level portion 34 of base 24. For example, first track portion 68 may be pivotally connected to upper level portion 34 such that the first track portion may be selectively inclined, such as inclined downwardly toward the third track portion. Although first track portion 68 is discussed to be pivotally connected to upper level portion 32, the first track portion may alternatively, or additionally, be slidingly and/or rotatably connected to any suitable portion(s) of the base.

Second track portion 70 may include a first end portion 74 and a second end portion 76. The first end portion may be connected to the third track portion, while the second end portion may be spaced away from the first end portion. First end portion 74 may be at least partially supported on the upper level portion of base 24, while the second end portion may be at least partially supported on the lower level portion of base 24 with the second track portion curving and/or inclining downwardly from the first end portion toward the second end portion. Although second track portion 70 is shown to include a particular shape that curves downwardly, the second track portion may alternatively, or additionally, include any suitable shape(s). In some embodiments, second track portion 70 may be movably connected to the base.

The third track portion may include a door 78 configured to move between a closed position D, shown in FIG. 3, and an open position N, shown in FIG. 1. In the closed position, the first, second, and third track portions may form a continuous track allowing moveable object 22 to move from the first track portion toward the second track portion. In the open position, door 74 may be spaced away from the first and second track portions forming an opening 80 in the third track portion through which an object, such as moveable object 22, can pass and/or be diverted from the track. In some embodiments, opening 80 may lead to first holding area 42. In some embodiments, the track may be referred to as including opening 80 through which an object can pass, and the door may be considered to be mounted relative to the track and configured to move between closed position D in which the door closes the opening, and open position N in which the door is spaced from the opening.

In some embodiments, third track portion 72 may include a bias mechanism 82 configured to urge the door toward the closed and/or open positions. The bias mechanism may include one or more bias elements, such as coil spring(s), leaf spring(s), musical wire(s), etc. The urging of the bias mechanism may be sufficient to maintain the door in the closed position against the weight of moveable object 22 supported on the door, but may not be sufficient to maintain the door in the closed position against the weight of moveable object 22 supported on the door and additional force(s) from the regulating assembly, such as an actuator of the regulating assembly pressing the moveable object against the door.

In some embodiments, door 78 may alternatively, or additionally, be moved between the open and the closed positions via the regulating assembly (as further discussed below). Although opening 80 is sized to allow a single moveable object 22 to pass through, the opening may be sized to allow two or more of the moveable objects to pass through. Additionally, although third track portion 72 is shown to include door 78, the third track portion may alternatively, or additionally, include other suitable structure(s) configured to divert moveable object 22 and/or prevent that object from moving from the first track portion toward the second track portion.

Regulating assembly 28 may include any suitable structure configured to regulate movement of the at least one movable object on toy track device. For example, regulating assembly 28 may include a lift mechanism 84, a launch assembly 86, a restraining mechanism 88, an actuator mechanism 90, and an indexing mechanism 92. Lift mechanism 84 may include any suitable structure configured to move the moveable object between the lower level and upper level portions of base 24. For example, the lift mechanism may include elevator 94 that may be slidingly connected to the base and be configured to move at least one of the moveable objects between the lower level and the upper level portions of the base.

Although elevator 94 is shown to be slidingly connected to the base, the elevator may alternatively, or additionally, be pivotally and/or rotatably connected to the base. Additionally, although elevator 94 is shown to be sized to move a single moveable object, the elevator may alternatively be sized to move two or more of the moveable objects. Moreover, although lift mechanism 84 is shown to include elevator 94, the lift mechanism may include any suitable structure configured to move one or more of moveable object 22 between the upper and lower level portions of the base. Furthermore, elevator 94 may be connected to one or more other components of the toy track device, such as via indexing mechanism 92 discussed below, such that movement of elevator 94 may move one or more other components of the toy track device.

Launch assembly 86 may include any suitable structure configured to selectively propel moveable object 22 along the track, such as from first track portion 68 toward second track portion 70. For example, launch assembly 86 may include an incliner 96 that may be configured to selectively incline first track portion 68 downwardly toward the third track portion. The incliner may be pivotally connected to the base and include at least one user-manipulable portion 98 to allow a user to grasp the user-manipulable portion and shift the incliner toward one or more directions, which may cause the incliner to incline the first track portion.

Although the incliner is shown to include a user-manipulable portion allowing a user to grasp and move the incliner relative to the base, the launch assembly may include a separate actuating member to cause the incliner to incline the first track portion. Additionally, although launch assembly 86 is shown to include incliner 96, the launch assembly may alternatively, or additionally, include other suitable structure(s) configured to selectively propel moveable object 22 along the track. For example, launch assembly 86 may include one or more ejection mechanisms. Moreover, although incliner 96 is sized to propel a single moveable object 22, the incliner may be sized to propel two or more of the moveable objects.

Furthermore, although incliner 96 is shown to be pivotally connected to the base, the incliner may alternatively, or additionally, be slidingly and/or rotatably connected. Additionally, although incliner 96 is shown to move first track portion 68, the first track portion may additionally, or alternatively, moved by one or more other components of the toy track device, such as via indexing mechanism 92 described below. Moreover, incliner 96 may be incorporated into one or more other components of the toy track device. For example, incliner 96 may be incorporated with launch assembly 86 such that a user may raise moveable object 22 from the lower level portion to the upper level portion and then propel the moveable object with a single mechanism.

Restraining mechanism 88 may include any suitable structure configured to restrain moveable object 22 at one or more positions, such as on the door of the third track portion and/or adjacent the second end portion of the second track portion. For example, the restraining mechanism may include a first restrainer 100, a second restrainer 102, a first mover 104, and a second mover 108.

The first restrainer may be configured to move between a first restrained position R, shown in FIG. 1, in which the moveable object is restrained from moving toward the second end portion of the second track portion at a first position along the first, second, and third track portions, and a first unrestrained position U, shown in FIG. 2, in which the moveable object is allowed to move from the first position toward the second end portion of the second track portion. First mover 104 may include any suitable structure configured to move the first restrainer between the first restrained position and the first unrestrained position. In some embodiments, the first mover may be incorporated with one or more other components of the toy track device. For example, the first mover may be incorporated with the incliner of the launch assembly such that inclining the first track portion may move the first restrainer between the first restrained position and the first unrestrained position.

Second restrainer 102 may be configured to move between a second restrained position S, shown in FIG. 3, in which the at least one movable object is restrained from moving toward the second end portion of the second track portion at a second position along the first, second, and third track portions, and a second unrestrained position V, shown in FIG. 1, in which the at least one movable object is allowed to move from the second position toward the second end portion of the second track portion.

In some embodiments, the first position may be on a different part of the first, second, and third track portions than the second position. Second mover 106 may include any suitable structure configured to move the second restrainer between the second restrained position and the second unrestrained position. For example, the second mover may include a button 108 configured to move the second restrainer from the second restrained position to the second unrestrained position. Alternatively, the second mover may be incorporated with one or more other components of the toy track device, such as the first mover.

In some embodiments, the restraining mechanism may include one or more bias elements (not shown) to urge the first and/or second restrainers toward the restrained and/or unrestrained positions. Although first and second restrainers 100, 102 are shown to restrain moveable object 22 at particular positions, the first and second restrainers may alternatively, or additionally, restrain the moveable object at any suitable positions. Additionally, although restraining mechanism 88 is shown to include two restrainers, the restraining mechanism may include any suitable number of restrainers. Moreover, although restraining mechanism 88 is shown to include first and second restrainers 100, 102 and first and second movers 104, 106, the restraining mechanism may include any suitable structure configured to restrain moveable object 22 at any suitable position(s) along track 66.

Actuator mechanism 90 may include any suitable structure configured to move door 78 between the open and closed positions. For example, the actuator mechanism may include an actuator 110 and a trigger 111. The actuator may be configured to move between an extended position E, shown in FIG. 2, in which the actuator is adjacent to door 78, and a retracted position T, shown in FIG. 1, in which the actuator is spaced away from the door. Actuator 110 may contact moveable object 22 when the moveable object is supported on door 78 and the actuator is moved from the retracted position toward the extended position. As discussed above, door 78 may be configured to move from the closed position to the open position when moveable object 22 is supported on door 78 and actuator 110 presses against the moveable object while the actuator is moving from the retracted position toward the extended position. Trigger 111 may move the actuator between the extended position and the retracted position.

In some embodiments, actuator mechanism 90 may be referred to as being operable to move door 78 from the closed position toward the open position by moving actuator 110 from the retracted position toward the extended position. In some embodiments, the moveable object may be referred to as being part of actuator mechanism 90 and the door may be referred to as being configured to open when the actuator presses the moveable object against the door while moving from the retracted position toward the extended position.

Although trigger 111 is shown to move the actuator between the extended and retracted positions, the actuator may additionally, or alternatively, be moved by one or more other components of the toy track device, such as via the indexing mechanism discussed below. Additionally, although the actuator is shown to move between the extended and retracted positions, the actuator may additionally, or alternatively, be configured to move any suitable position(s).

Moreover, although trigger 111 is shown to be a standalone trigger, the trigger may be incorporated into one or more other components of the toy track device. For example, trigger 111 may be incorporated with first restrainer 100 such that movement of the first restrainer from the first unrestrained position to the first unrestrained position may activate trigger 111 to move actuator 110 from the retracted position toward the extended position. Furthermore, although actuator mechanism 90 is shown to include actuator 110 and trigger 111, the actuator mechanism may include any suitable structure configured to move door 78 between the open and closed positions.

Indexing mechanism 92 may include any suitable structure configured to operatively connect one or more components of the toy track device with one or more other components of the toy track device. For example, indexing mechanism 92 may operatively connect restraining mechanism 88 with launch assembly 86 such that launching or propelling the moveable object toward second track portion 70 may lead to movement of at least one of the first and second restrainers. In some embodiments, indexing mechanism 92 may be referred to as being configured to move first restrainer 100 between the first restrained position and the first unrestrained position and/or second restrainer 102 between the second restrained position and the second unrestrained position.

Figure 4:
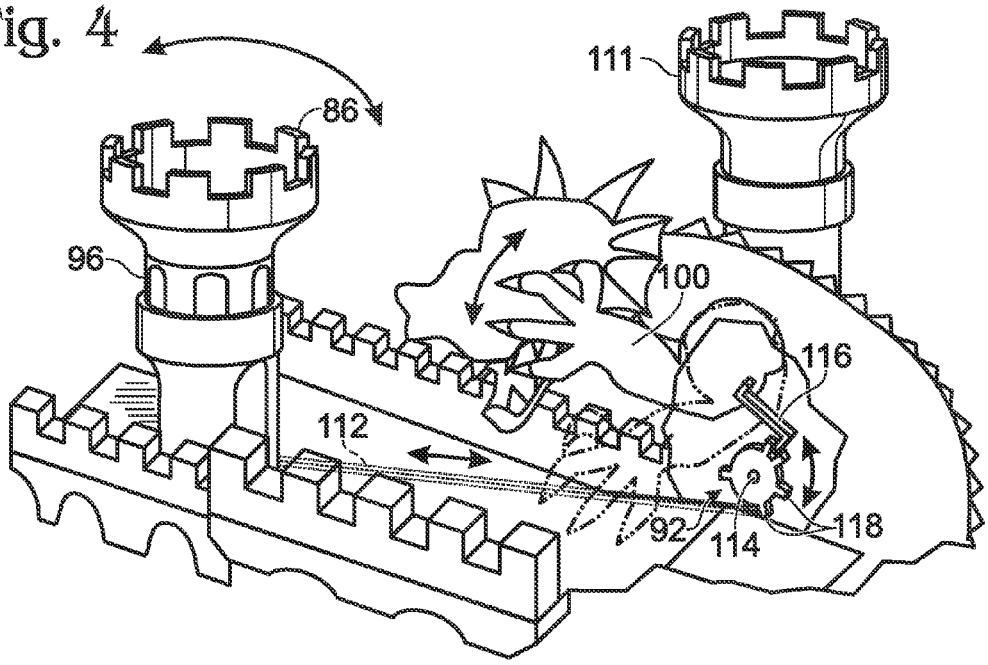
FIG. 4 is a partial isometric view of the toy track device of FIG. 1 with some portions cut-away to show an indexing mechanism.

Indexing mechanism 92 may include any suitable structure, such as one or more connectors 112, an indexed cam 114, and one or more cam followers 116, as shown in FIG. 4. The connectors may operatively connect one or more other components of the toy track device, such as incliner 96 of launch assembly 86, with the indexed cam such that movement of the other component(s) moves the indexed cam one or more positions. When launch assembly 86 is operatively connected to the indexed cam via connectors 112, the launch assembly may be referred to as being configured to actuate indexing mechanism 92, such as when the moveable object is propelled toward the second track portion.

Indexed cam 114 may include a plurality of cam teeth 116 that may engage the cam followers. The cam teeth may be "even" (spaced evenly or arranged evenly) for predictable movement of the cam followers or may be "uneven" (spaced unevenly or arranged unevenly) to provide for random or pseudorandom movement of the cam followers. Cam followers 114 may operatively connect the indexed cam with one or more other components of the toy track device, such as first restrainer 100 and/or second restrainer 102. Thus, the position of the cam followers may determine the position of one or more other components of the toy track device, such as the first and/or second restrainers.

Although indexed cam 114 is shown to have teeth 116 arranged in an uneven order, the teeth may alternatively be arranged in an even order. Additionally, although connectors 112 are shown to operatively connect incliner 96 to the indexed cam, the connectors may additionally, or alternatively, operatively connect one or more other components of the toy track device, such as lift mechanism 84, first trigger 56, second trigger 58, button 108, and/or trigger 111. Moreover, although cam followers 114 is shown to operatively connect indexed cam 114 to first restrainer 100, the cam followers may additionally, or alternatively, operatively connect the indexed cam to one or more other components of the toy track device, such as second restrainer 102, one or more holding doors 38, and/or actuator 110. For example, the cam followers may operatively connect the indexed cam to the actuator such that the indexing mechanism may be configured to move the actuator between the extended and retracted positions.

Furthermore, although indexing mechanism 92 is shown to include a single indexed cam 114, the indexed mechanism may include two or more indexed cams that may operatively connect other components of the toy track device. Additionally, although indexing mechanism 92 is shown to include connectors 112, indexed cam 114, and cam followers 116, the indexing mechanism may include any suitable structure configured to operatively connect one or more components of the toy track device with one or more other components of the toy track device.

Figure 12:
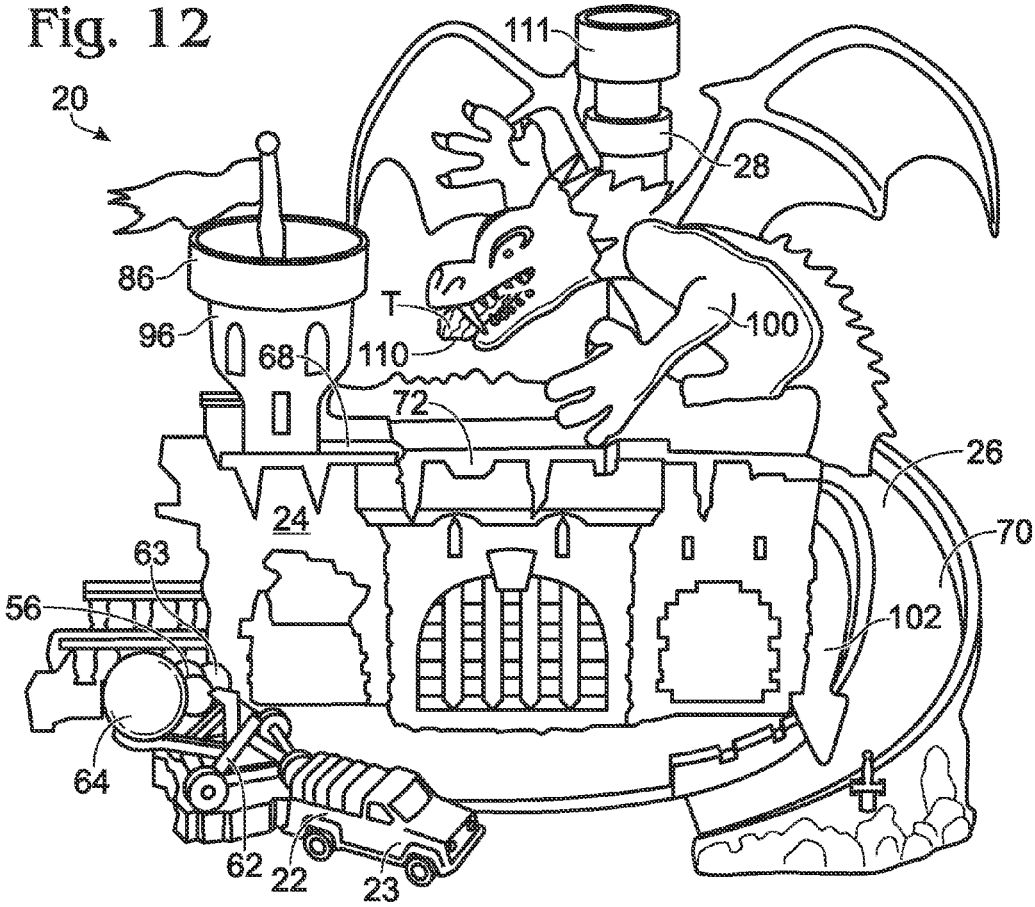
FIG. 12 is another example of a toy track device.

The toy track device may include one or more variations of the base, track assembly, and/or regulating assembly. For example, as shown in FIGS. 7-11, first trigger 56 (which opens first holding door 48) may be incorporated with one or more other components of the toy track device, such as second trigger 58 (which opens second holding door 50). Alternatively, or additionally, as is the case for the example shown in FIG. 12, first trigger 56 may be incorporated with launch trigger 63. Additionally, or alternatively, trigger 111 may move the door from the closed position to the open position regardless of whether actuator 110 contacts the moveable object, as is the case for the example shown in FIG. 12.

The toy track device may additionally, or alternatively, include any suitable ornamentation and/or aesthetic features. For example, the toy track device may resemble a toy castle with a toy dragon guarding the castle. Incliner 96 of launch assembly 86 and/or first mover 104 may be tower(s) of the toy castle. Additionally, holding doors 38 may be doors to the toy castle. Moreover, first restrainer 100 and second restrainer 102 of restraining mechanism 88 may be a claw and a tail of the toy dragon, respectively. Furthermore, actuator 110 may be toy fire from the mouth of the toy dragon, while first trigger 56 may be a wing of the toy dragon. Although the toy track device is shown to include particular ornamentation and aesthetic features, the toy track device may alternatively, or additionally, include any suitable ornamentation and/or aesthetic features. For example, the toy track device may resemble a mountain guarded by a dinosaur.

Additionally, or alternatively, the toy track device may include audio and/or visual mechanisms configured to produce light and/or sound effects. Those light and/or sound effects may be synchronized with one or more movements of the actuator and/or other component(s) of the toy track device. For example, a first dragon sound effect may be generated when the actuator is moved from the retracted position toward the extended position, while a second dragon sound effect may be generated when the first holding door is moved from the closed position to the open position. Additionally, or alternatively, lamps may be provided in one or more portions of the toy dragon, such as for the eyes and/or the toy fire, to provide light effects.

In operation, a user may move holding doors 38 to the closed positions and move first restrainer 100 to the first unrestrained position. The user may then put toy vehicle 23 on elevator 94 and move the toy vehicle to first track portion 68. When the toy vehicle is on the first track portion, the user may grasp user-manipulable portion 98 of incliner 96 and pivot the incliner to propel the toy vehicle toward second track portion 70. Pivoting of the incliner may move indexed cam 114 of the indexing mechanism and, depending on whether a tooth of the indexed cam contacts a cam follower, may move first restrainer 100 to the first restrained position.

If the first restrainer is not moved to the first restrained position, then the toy vehicle may travel along the track and may be restrained by second restrainer 102. The user may release the toy vehicle by pushing on button 108, which may move second restrainer 102 to the second unrestrained position. The toy vehicle may then move toward the second end portion of the second track portion and off the track. The user may activate second trigger 58, if accessible, to move second holding door 50 to the open position. With the second holding door opened, the user may access second holding area 44 to get the toy treasure. The toy treasure may be loaded on to the toy vehicle and be driven off.

If the first restrainer is moved to the first restrained position, then the toy vehicle may be restrained on door 78. The user may then activate trigger 111, which may move actuator 110 from the retracted position toward the extended position. The actuator may contact the toy vehicle and may cause the door to move from the closed position to the open position. With the door in the open position, the toy vehicle may fall through opening 80 into first holding area 42. The user may propel launch member 64 via launch mechanism 62 at first trigger 56. If the user contacts the first trigger, then first holding door 48 may be moved from the closed position to the open position allowing the user to access first holding area 42. The user may then retrieve the toy vehicle from the first holding area, get the toy treasure as described above, and drive off with that treasure. Although a particular operation of the toy track device is discussed, many variations to the operation may be made.

Although the present invention has been shown and described with reference to the foregoing operational principles and preferred embodiments, it will be apparent to those skilled in the art that various changes in form and detail may be made without departing from the spirit and scope of the invention. For example, variations in the details of the toy track device appearance, the moveable object, and operation of the toy track device may be envisioned. The present invention is intended to embrace all such alternatives, modifications and variances that fall within the scope of the appended claims.

What is claimed is:

1. A toy track device for at least one moveable object, comprising:

first and second track portions;

a third track portion disposed between the first and second track portions, the third track portion including a door configured to move between a closed position in which the first, second, and third track portions form a continuous track, and an open position in which the door is spaced from the first and second track portions forming an opening in the third track portion through which the at least one moveable object can pass; and an actuator mechanism including an actuator configured to move between an extended position in which the actuator is adjacent to the door, and a retracted position in which the actuator is spaced from the door, the actuator configured, while the at least one moveable object is restrained on the door, to contact and press the at least one moveable object against the door when the actuator is moved from the retracted position toward the extended position, wherein the door is configured to move from the closed position to the open position responsive to the actuator pressing the at least one moveable object against the door.

2. The toy track device of claim 1, wherein the second track portion includes a first end portion connected to the third track portion and a second end portion spaced from the first end portion, and further comprising a restraining mechanism including a first restrainer configured to move between a first restrained position in which the at least one moveable object is restrained at a first position on one of the first, second, and third track portions, and a first unrestrained position in which the at least one movable object is allowed to move from the first position toward the second end portion of the second track portion.

3. The toy track device of claim 2, wherein the first restrainer is configured to restrain the at least one movable object on the door of the third track portion when the first restrainer is in the first restrained position.

4. The toy track device of claim 2, wherein the restraining mechanism includes a second restrainer configured to move between a second restrained position in which the at least one moveable object is restrained at a second position on one of the first, second, and third track portions, and a second unrestrained position in which the at least one movable object is allowed to move from the second position toward the second end portion of the second track portion, wherein the first position is spaced from the second position.

5. The toy track device of claim 4, further comprising an indexing mechanism configured to move at least one of the first restrainer between the first restrained position and the first unrestrained position and the second restrainer between the second restrained position and the second unrestrained position.

6. The toy track device of claim 5, wherein the indexing mechanism includes an indexed cam having a plurality of cam teeth and cam followers, and the position of the cam followers determine the position of at least one of the first and second restrainers.

7. The toy track device of claim 5, further comprising a launch assembly configured to selectively propel the at least one moveable object toward the second track portion.

8. The toy track device of claim 7, wherein the launch assembly is configured to selectively incline the first track portion downwardly toward the third track portion.

9. The toy track device of claim 8, wherein the launch assembly is further configured to actuate the indexing mechanism when the at least one moveable object is propelled toward the second track portion.

10. The toy track device of claim 1, further comprising a holding area positioned below the third track portion.

11. The toy track device of claim 10, wherein the holding area includes a holding door configured to move between a closed position in which removal of the at least one moveable object from the holding area is prevented, and an open position in which removal of the at least one movable object from the holding area is allowed.

12. The toy track device of claim 11, further comprising an access mechanism including at least one trigger, the access mechanism configured to move the holding door from the closed position to the open position.

13. The toy track device of claim 12, further comprising a launch mechanism and a launch member, wherein the launch mechanism is configured to launch the launch member toward the at least one trigger of the access mechanism, and wherein the access mechanism is configured to move the holding door from the closed position to the open position responsive to the launch member contacting the at least one trigger.

14. A toy track device for at least one toy vehicle, comprising:

first and second track portions;

a third track portion disposed between the first and second track portions, the third track portion including a door configured to move between a closed position in which the first, second, and third track portions form a continuous track, and an open position in which the door is spaced away from the first and second track portions forming an opening in the third track portion through which the at least one toy vehicle can pass;

an actuator mechanism including an actuator configured to move between an extended position in which the actuator is adjacent to the door, and a retracted position spaced from the door, the actuator configured, while the at least one toy vehicle is supported on the door, to contact and press the at least one toy vehicle against the door when the actuator is moved from the retracted position toward the extended position, wherein the door is configured to move from the closed position to the open position responsive to the actuator pressing the at least one toy vehicle against the door; and an indexing mechanism configured to move the actuator between the extended and retracted positions.

15. The toy track device of claim 14, further comprising a launch assembly configured to selectively propel the at least one toy vehicle toward the second track portion.

16. The toy track device of claim 15, wherein the launch assembly is configured to selectively incline the first track portion downwardly toward the third track portion.

17. The toy track device of claim 16, wherein the launch assembly is further configured to actuate the indexing mechanism when the at least one toy vehicle is propelled toward the second track portion.

18. The toy track device of claim 14, further comprising a holding area positioned to receive the at least one toy vehicle when the toy vehicle passes through the opening.

* * * * *